US006080223A

United States Patent [19]

Mavronis

[11] Patent Number: 6,080,223

[45] Date of Patent: Jun. 27, 2000

[54] FLAME DETECTION MONITORING SYSTEM FOR DETECTING BLOCKAGES IN BLAST FURNACE INJECTION PATHS

[75] Inventor: Nicholas S. Mavronis, Baltimore, Md.

[73] Assignee: Bethlehem Steel Corporation, Del.

[21] Appl. No.: 08/921,385

[22] Filed: Aug. 29, 1997

[51] Int. Cl.[7] ..... C21C 1/04

[52] U.S. Cl. ..... 75/375; 266/80; 266/99; 266/100

[58] Field of Search ..... 266/80, 99, 100; 75/375; 340/578, 540

[56] References Cited

U.S. PATENT DOCUMENTS 4,619,533 10/1986 Lucas et al. .
4,651,976 3/1987 Arima et al. .
4,749,171 6/1988 Arima et al. .
4,759,299 7/1988 Kennedy et al. .
5,071,105 12/1991 Donze et al. .
5,397,108 3/1995 Alexander et al. .
5,481,247 1/1996 Alexander et al. .
5,830,407 11/1998 Cates ..... 266/100

FOREIGN PATENT DOCUMENTS 0125307 7/1985 Japan ..... 266/100

*Primary Examiner*—Scott Kastler

[57] ABSTRACT

A flame detection system for detecting blockage in oil injection paths into blast furnaces utilized in the manufacture of iron. The flame detection system, as designed and installed, monitors the amount of light seen through a blowpipe peephole and causes an alarm to be actuated when a voltage falls below a predetermined threshold thereby indicating that the amount of light being received by a photocell mounted at the peephole is at a low enough level to possibly indicate injection path or port clogging. Efficient calibration circuitry and techniques are also provided.

17 Claims, 4 Drawing Sheets

18–24v AC or DC
1A
F1
IN4005
Q1
F1MC7815
1000μf
.1μf
10μf
470Ω
+15v
5.1v REF.
CAD CELL INPUT
CAD CELL CAL
OPEN COLLECTOR
CALIBRATION PUSH BUTTONS
IN4005
IN916
U3-a
U3-CD-40107
U3
U1-LM324
U1a
U1b
U1c
U1d
U2 LM311
TP1
TP2
TP3
TP4
GAIN ADJUST
GREEN
RED
LOW LEVEL ALARM
ALARM ADJ.
SIG. < REF = RED LED
SIG. > REF = GREEN LED
OUTPUT 0–10v
COM TO BRD
12v DC EXT. SUPPLY ONLY
CNTR. CONTACT
RELAY
S1
S2
S3
0%
50%
100%
1v REF.
5v REF.
R1
50k
100SL
5k
10k
1k
3k
12k
1.3k
5.1k
510k
510Ω
470Ω
10k
1k
1μf
.1μf
10μf

FLAME DETECTION MONITORING SYSTEM FOR DETECTING BLOCKAGES IN BLAST FURNACE INJECTION PATHS

This invention relates to a system and method for detecting blockages of injection path(s) into a blast furnace. More particularly, this invention relates to a system and method for monitoring the amount of light seen by a photosensitive resistor through a blowpipe peephole in such a blast furnace, and detecting potential injection path blockage based upon same.

BACKGROUND OF THE INVENTION

Blast furnaces are used in the manufacture of iron, such furnaces including multiple (e.g. 38) oil and hot gas (e.g. air) injection path(s). Oil and hot gas are injected into a blast furnace through tuyeres that are attached to corresponding blowpipes, which is known in the art. A furnace may have, for example, thirty-eight or so different gas/oil injection ports. The converted energy produced (e.g. about 140.0 BTUs of heat/gallon of oil) reduces the need for the more expensive coke/BTU product.

Blockage of an injection port may occur, for example, as a result of material falling and accumulating in front of the tuyere nozzle. If left undetected or unclogged, oil may back up in the blowpipe, possibly causing a flood or other undesirable furnace condition(s). Thus, we have the need for detecting such clogging or blockage.

Prior art systems for detecting clogged or blocked tuyeres are known in the art. One prior art system includes a circuit where a set point is selected to determine whether a relay picks up or drops out. This turns indicators on or off to display strong or weak signals. This circuit/system has problems in processing weak signals effectively, as there are no calibration or adjustment procedures, and no references to follow. Furthermore, it is difficult for this system to isolate problems, and maintain signal strength. Optical fiber bundles used for light detection are susceptible to breaking, being scratched by dirt accumulation, and degradation. Also, the signal has to overcome a minimum threshold level (1 vdc) before it becomes noticeable in this prior art system.

U.S. Pat. No. 5,481,247 discloses a blast furnace tuyere sensor system, including generating analog voltages from tuyere sensors in order to monitor light intensity trends of all tuyeres in the furnace. Alarms are actuated when light intensity becomes abnormally low or abnormally high. By continuously detecting and measuring changing intensity of light from each blast furnace tuyere, and actuating alarms when the measured analog voltage signal deviates from a base load voltage by more than a predetermined percentage, both bright tuyeres and blocked tuyeres are detected. For example, in the '247 patent, the base load may be fifty percent (50%) of the sensor voltage span, and alarms are actuated when the measured voltage is either from 5–10% (blocked tuyere) of the voltage span or from 85–90% (bright tuyere) of the voltage span. The '247 patent also requires a complex system for detecting if and when a sensor emits a straight line signal, or becomes unstable via erratic swings in measured voltage, and generates alarm signals in response thereto. Unfortunately, the system of the '247 patent is undesirable because: (i) it requires a potentiometer to adjust the circuit voltage to a mid-point base load value; (ii) it lacks as to efficient calibration; (iii) it requires complex circuitry or the like which detects and looks for straight line and unstable signals; (iv) it sets off alarms only when the measured voltage is below or above the base load by greater than a certain percentage; (v) undesirable amplification characteristics and calibration are used; (vi) the optical fiber connected to each sensor is susceptible to scratches, breakage, too small of a light gathering area, and adverse effects due to moisture; and (vii) circuit flaws or problems are not easily identifiable.

U.S. Pat. No. 5,397,108 discloses a peepsight for a blast furnace tuyere sensor system, but does not disclose or suggest circuitry or the like to overcome the problems with the '247 patent set forth above. The '108 patent also suffers from the problem that the illustrated optical fiber or cable is disadvantageous for the reasons discussed above.

It is apparent from the above that there exists a need in the art for an improved system and corresponding method for detecting potential clogging of blast furnace injection paths, the improved system including efficient calibration techniques, efficient means of identifying circuit problems or errors, efficient light intensity detection proximate the peepholes, efficient and simple circuitry, the ability to detect both strong and weak signals, and circuitry enabling easy isolation of problems using external calibration. This invention will now be described with respect to certain embodiments thereof, accompanied by certain illustrations wherein:

SUMMARY OF THE INVENTION

Generally speaking, this invention fulfills the above-described needs in the art by providing a method of detecting potential blocking or clogging of a tuyere in a blast furnace, the method comprising the steps of:

- positioning a photosensitive sensor adjacent the tuyere, the sensor including an electrical parameter that varies as a function of received intensity of light from within the furnace impinging upon the sensor through the tuyere;
- calibrating a circuit so that a standard voltage is forwarded by the sensor toward amplifying means when the photosensitive sensor detects a predetermined reference amount of light;
- the sensor detecting light from within the furnace through the tuyere and forwarding an actual sensed signal toward the amplifying means in response thereto;
- amplifying the actual sensed signal forwarded from the sensor, by utilizing the amplifying means, so as to form an amplified signal having a voltage that is indicative of light intensity within the furnace adjacent the tuyere;
- providing a threshold voltage which is a predetermined percentage of the standard voltage amplified by the amplifying means; and
- comparing the voltage of the amplified signal to the threshold voltage and actuating an alarm when the voltage of the amplified signal is less than the threshold voltage thereby indicating potential clogging or blockage of the tuyere.

This invention further fulfills the above-described needs in the art by providing a combination peepsight and light detector for use in a blast furnace tuyere sensor system, the combination comprising:

- a tuyere communicating with the interior of the furnace;
- a blowpipe through which oil and heated gas (e.g. air) are blown into the blast furnace;
- an oil channel defined in the blowpipe through which oil is directed toward the furnace;
- a peepsight structure connected to the blowpipe so that the peepsight structure, the tuyere, and the blowpipe are positioned along a common axis;

a photoresistive photocell detachably connected to the peepsight structure with the photocell including a resistive element whose resistance varies as a function of light intensity received from the interior of the furnace; and a light absorbing or reflecting optical filter positioned inboard of the photocell and outboard of the peepsight structure so as to be located between the photocell and the peepsight, thereby enabling the photocell to view the interior of the furnace through the peepsight structure and the optical filter. Another light absorbing or reflecting filter may be provided within the peepsight structure.

This invention will now be described with respect to certain embodiments thereof, along with reference to the accompanying illustrations, wherein:

IN THE DRAWINGS

Figure 3:
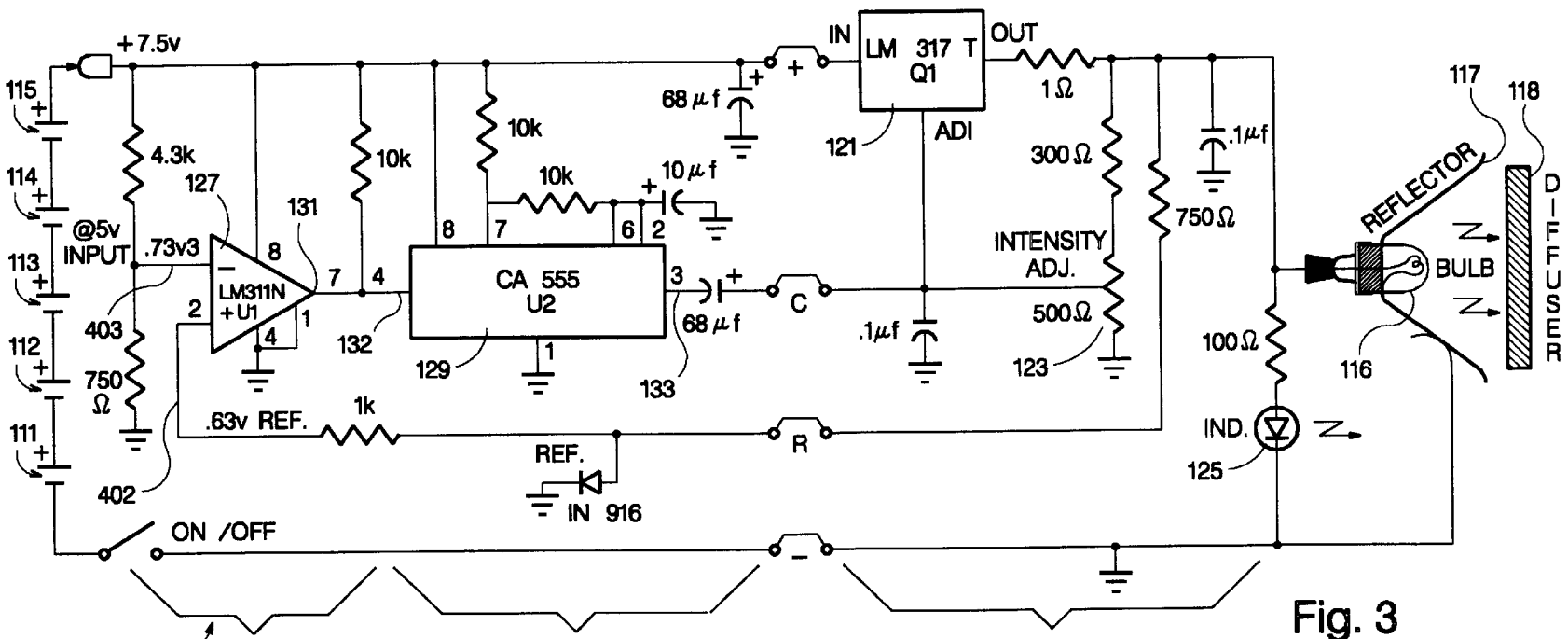
FIG. 3 is a circuit diagram of a reference light source to be used during calibration of the circuits of FIGS. 1 and 2, according to an embodiment of this invention, with the lower pair of circular drawings in this figure illustrating boards implementing the illustrated circuitry.
Figure 3B:
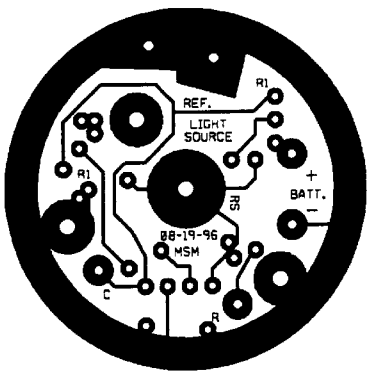
Figure 3A:
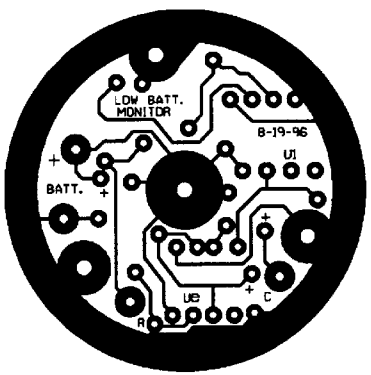

FIGS. 3(*a*) and 3(*b*) illustrate a pair of circuit boards for implementing the FIG. 3 circuitry.

Figure 4:
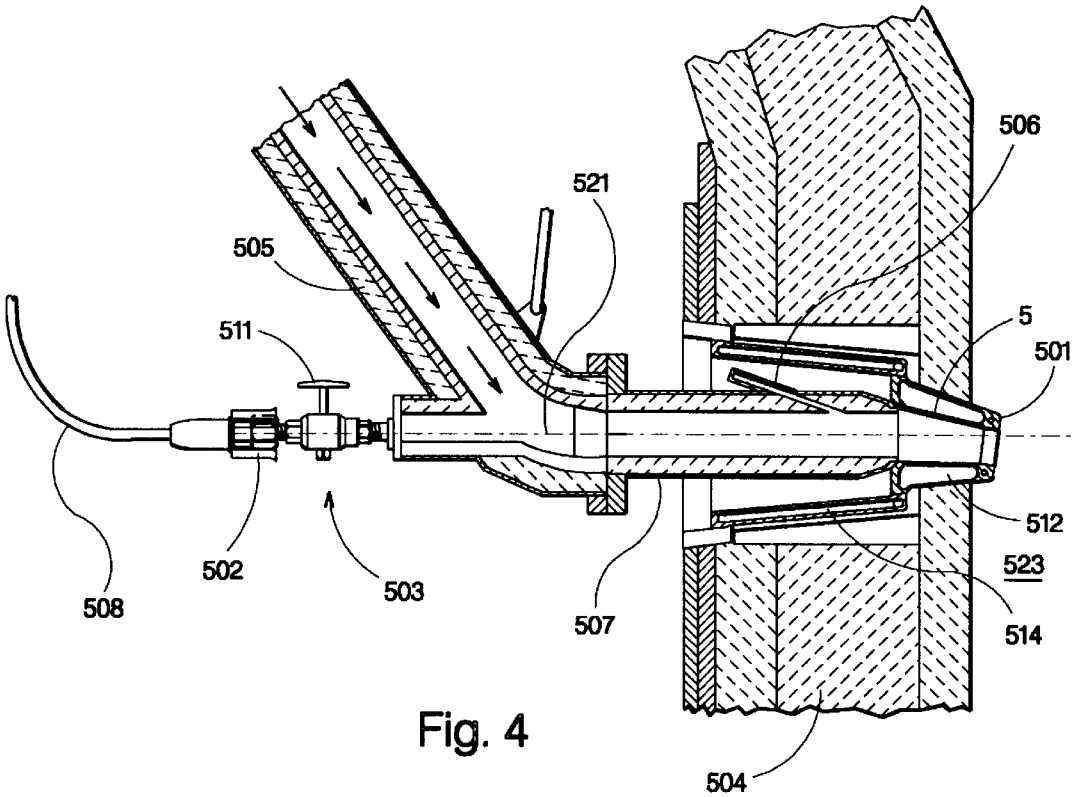

FIG. 4 is a side cross-sectional view of a blast furnace tuyere with a blowpipe clip connected to the peepsight or peephole, according to an embodiment of this invention.

Figure 5:
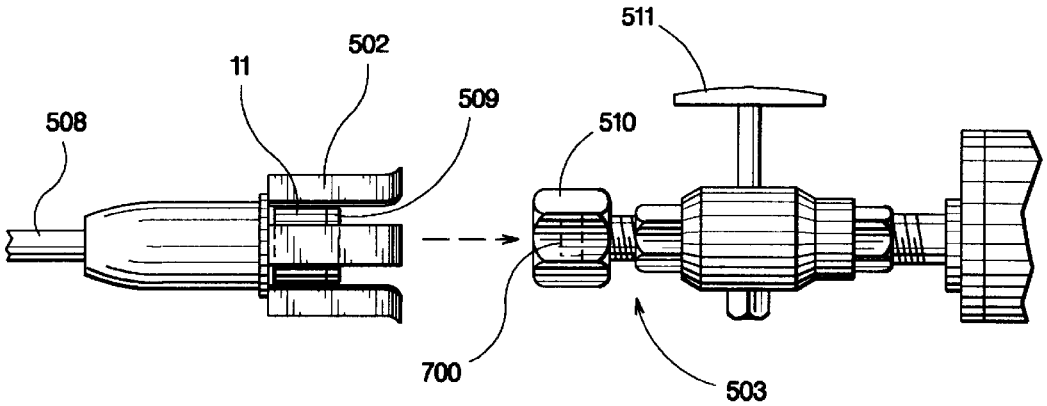

FIG. 5 is an enlarged side view of the FIG. 4 clip proximate the peephole sight.

DETAILED DESCRIPTION OF CERTAIN EMBODIMENTS OF THIS INVENTION

Referring now to the various figures in which like reference numerals indicate like parts throughout the several views.

The instant invention relates to a system and corresponding method for detecting blockage or clogging of oil/air/gas injection paths in blast furnaces used in the manufacture of iron. Typically, as shown in FIGS. 4–5, oil is injected into the furnace through oilers 506 defined in blowpipes 507 located in front of corresponding tuyeres 501. A blast furnace includes a plurality of tuyeres spaced circumferentially around and below a bosh of the furnace. According to certain embodiments of this invention, the furnace has a total of thirty-eight different oil and hot gas (e.g. air) injection ports and corresponding tuyeres 501, each having its own blowpipe 507, light detecting photocell 11, and tuyere stock 505 that delivers the hot blast from the bustle pipe (not shown). Although the preferred embodiment shows a system monitoring thirty-eight tuyere arrangements, it should be understood that the invention is applicable to a furnace with any number of tuyere arrangements. The FIG. 4 injection port may be used for injecting oil, and hot gas such as air into the furnace interior 523.

The converted energy produced by the oil, is approximately 140 BTUs of heat/gallon of oil in certain embodiments, which reduces the amount of higher priced coke used. This invention detects the blocking of oil or gas/air injection ports or paths, which may result from, for example, material falling or accumulating in front of tuyere nozzles 501. The flame detection system, as designed and installed, monitors the amount of light seen by a photosensitive resistor or photocell 11 through the blowpipe peepsight or peephole 503 along axis 521 for each injection port. Any blockage in the front of a blowpipe 507 or tuyere 501 will attenuate the amount of light given off by the oil injection flame within the furnace interior 523. In other words, a reduction in light emitted or detected by the photosensitive resistor 11 proximate the peephole is an indication that the injection path, port, or tuyere may be clogged.

Referring to FIGS. 4–5, the resistance of photocell 11 varies depending upon the amount of light from the furnace (or elsewhere) impinging on it, the structure further including spring loaded clip 502 for attaching photocell 11 and photocell cable 508 to peepsight 503, cobalt dark blue filter 509 mounted within clip 502 for solving ambient light problems, a light blue or clear filter 700 located inside of nut 510 of peepsight 503, valve 511 for selectively closing off the peepsight (e.g. when either of the filters is being replaced or when the clip 502 is taken off), tuyere cooling jacket (e.g. water cooled) 512, tuyere stock or duct 505, and blowpipe cooling jacket 514. The spring loaded clip 502 for each tuyere in the furnace is attached to the corresponding peephole nut 510 around the periphery thereof, with photocell 11 being located outboard of blue filter 509. Filter 509 may be located within clip 502 as illustrated [inboard of cell 11 and outboard of the peepsight structure], or alternatively may be located within the nut or peephole structure so that operators may look with their naked eyes into the furnace interior when clip 502 is removed or not attached to nut 510. In either event, cell 11 is positioned outboard of the filter. The peepsight structure, including elements 503, 510, 511, and an interior viewing passage or channel defined therein through which the furnace interior may be viewed, is connected to tuyere 501 and blowpipe 507 so that they all are aligned or oriented along a common axis 521 thereby allowing photocell 11 or an operator to view the furnace interior through the peepsight structure.

The peepsight slide assembly (FIGS. 4–5) is composed of nut 510 which is connected to cutoff valve 511 and attached to a slide wedge (not shown). When this slide assembly is installed behind blow pipe 507, it may be pounded in place using a hammer. In some cases, the result is that it does not align properly with the center of the flame within the furnace. To overcome this problem, a cadmium sulfide photoresistive cell 11 is used for flame detection, this type of cell 11 offering high sensitivity to light and a large surface area for gathering light (larger than many fiber optic sensors). These features of photocell 11 result in an advantage in flame detection in this type of environment, because dirt particles and sweat cannot blind the total light gathering area of cell 11.

In order to overcome ambient light problematic effects which occur when clip 502 and cell 11 fall of off the peepsight, cobalt blue filter 509 is provided within clip 502 as shown. Because of the high sensitivity of cell 11, it is able to penetrate and detect through both filters, and still detect significantly more light from the peepsight, than from the ambient when clip 502 hangs away from the sight.

Figure 1:
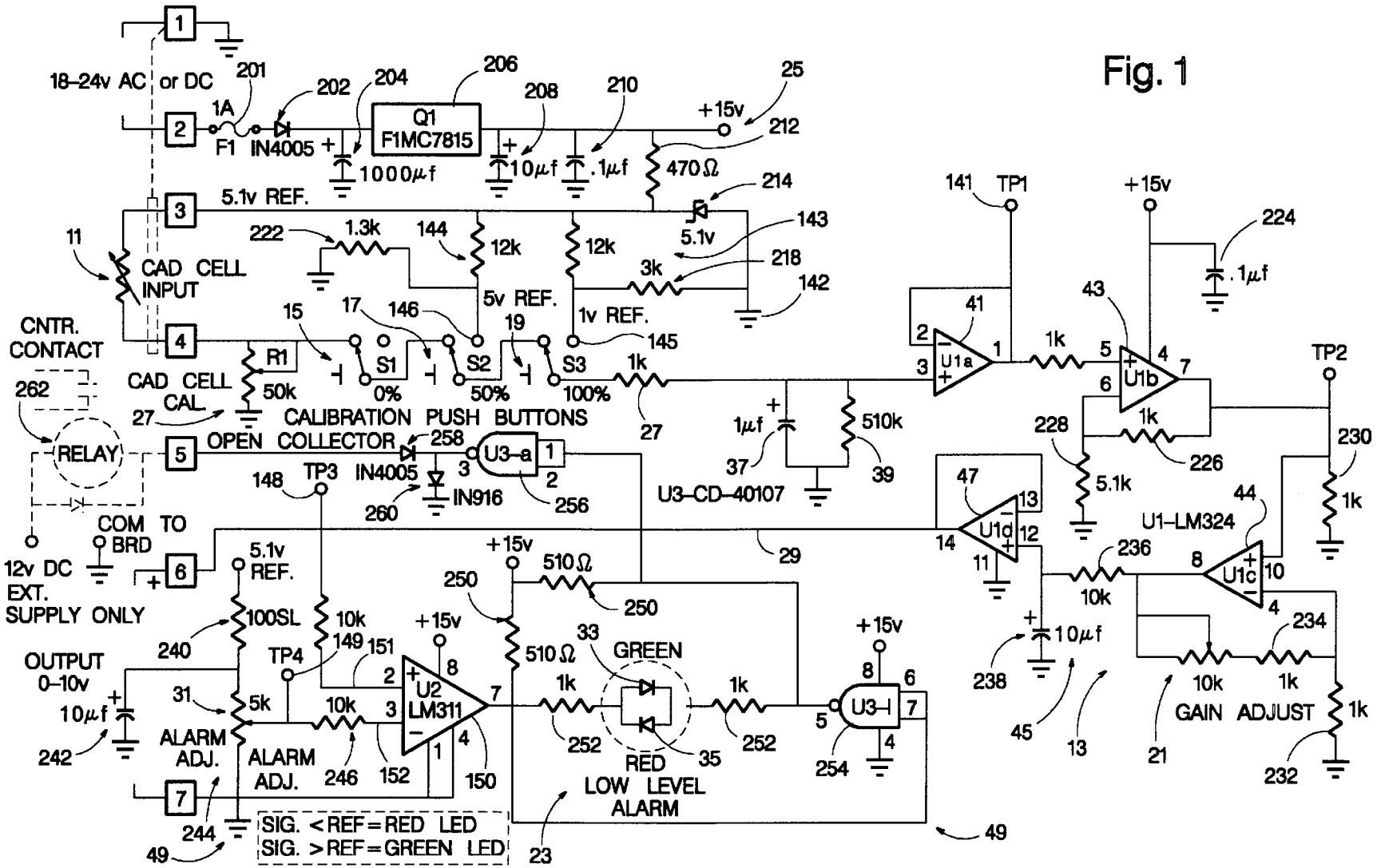
FIG. 1 is a circuit diagram of the flame detection and signal amplification circuitry according to an embodiment of this invention.

Referring to FIGS. 1 and 4–5, the system utilizes, for each of the tuyeres 501 in the furnace, a photocell 11 mounted on a heat isolated spring loaded clip 502 on top of a peephole nut assembly 510 attached to one end of blowpipe 507 adjacent a tuyere 501. Each photocell 11 is preferably a cadmium sulfide photosensitive resistor, although other known photocells may also be used. A different photocell 11 is mounted at the peephole 503 of each injection port in the furnace. The resistance of each photocell 11 changes inversely with the amount of light impinging thereon from the furnace through the peephole. The amount of resistance of photocell 11 is converted to a voltage signal, ranging in certain embodiments between 0 and 10 volts (i.e. the potential amplified photocell voltage output range). Each of the thirty-eight different injection ports in the furnace is monitored by a separate photocell 11, and the different outputs are fed into two opto-22 multi-channel analog module scanners (not shown) that are in communication with the circuit output at terminals 6 and 7 which are shown in FIG. 1. These modules transmit their signals via an RS-485 balance line into a data converter in a computer room, where a terminal server multiplexes the data and sends it through the ethernet to a VAX data collection computer. The VAX computer when requested, distributes available data via a local network, to various personal computers in the control room complex. The true analog values for all thirty-eight (or any other number in other embodiments) tuyere light intensity levels are displayed as a real numerical value or as a bar graph representation. The bar graphs are calibrated for 0–100% light intensity levels and have programmable low signal alarms for each one.

To maintain system calibration, two calibration aids are provided and discussed below, one of which is illustrated in FIG. 3 and is a 100% intensity reference light source with built-in voltage and current regulation. Its purpose is to standardize all of the different photocells 11 by shining a 100% reference light source into the photocell clip onto the cell 11, with an operator then adjusting or calibrating the circuitry in the FIG. 1 circuit so that each photocell 11 in the system sends out a standard voltage when hit with the reference light intensity/source, such as a 1.0 volt signal. This assures that all photocell 11 inputs to the amplifiers produce the same standard voltage signal (e.g. 1.0 volt) given a predetermined reference light source value. The reference light source of FIG. 3 can also be used to check the total system, from the photocell 11 to the bar graph scale on the PCs (not shown).

Figure 2:
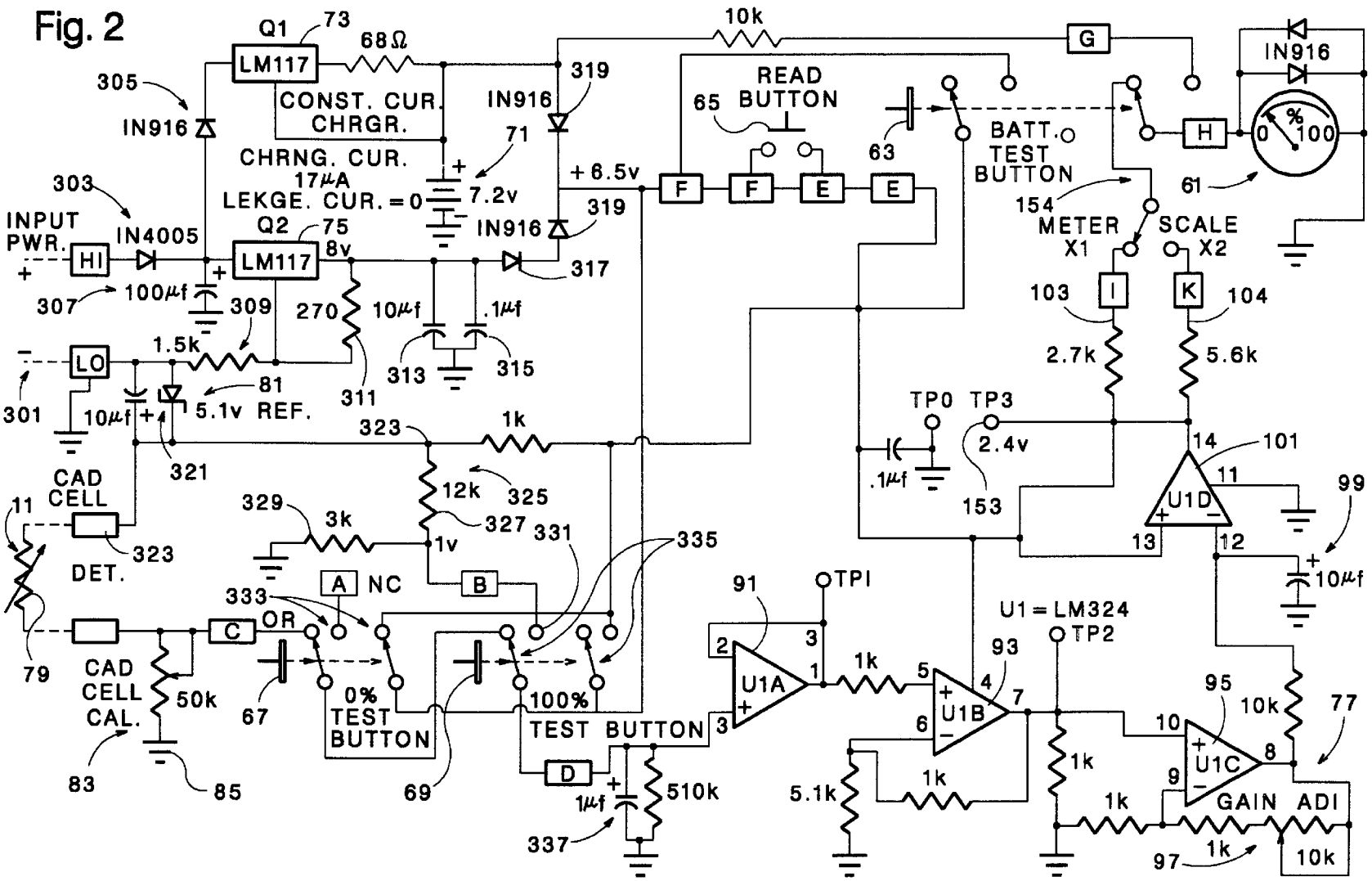
FIG. 2 is a circuit diagram of the flame intensity meter used during calibration of the circuitry of FIG. 1, according to an embodiment of this invention.

The other calibration aid is the stand alone flame intensity meter shown in FIG. 2 that clips onto peepsight nut 510 and displays the detected port flame or light intensity on a 100% or a 200% scale. These readings may be used to compare the system's validity and detect errors. The FIG. 2 meter system is separate and independent from the FIG. 3 reference light source and the FIG. 1 circuitry, while the FIG. 3 reference source is also separate and independent from the FIG. 1 detection and amplification circuitry.

FIG. 1 is a circuit diagram of the flame detection amplifier and detection circuitry according to certain embodiments of this invention. While hardware-type circuitry is used to implement the inventions herein, it will be recognized by those in the art that the inventions may also be implemented with software or the like.

The FIG. 1 circuitry converts a resistance change from photosensitive resistor photocell 11, which looks into the furnace through peephole 503, to a range of amplified voltage levels varying between 0 and 10 volts DC (or AC). Each volt represents a change of 10% in intensity level received by the photocell. The circuitry has its own on board +15 volt DC regulated power supply and accepts input voltages ranging from 18–24 volts AC or DC. The circuit generates its own reference voltage (e.g. 5.1 volts) used with photocell 11 and a level input control to assure, given a reference light source, that the signals from each of the thirty-eight photocells 11 produce the same standard voltage input (e.g. 1.0 volt) into their respective amplifiers.

As shown, the detection, amplification, and alarm circuitry of FIG. 1 includes the following components: an 18–24 volt AC or DC power supply connected to the circuit at points 1 and 2; one amp fuse 201; diode 202 which rectifies AC signals (when applicable) with corresponding 1,000 $\mu$F capacitor 204 acting as a filter; voltage regulator 206 which regulates the voltage from the power supply to a 15 volt value; the 15 volt signal filtered by the 10 $\mu$F capacitor 208 and the 0.1 $\mu$F capacitor 210; 470 ohm (Ω) resistor 212 limits the current applied to 5.1 volt zener diode 214; the above means providing the circuit reference voltage (e.g. 5.1 volts) at point 3; photocell 11 which has a resistance which is variable dependent upon the amount of light received through peephole 503; variable rheostat 27 including a 50 kΩ resistor which is adjustable in value so as to cause the voltage which is output toward the amplifying circuitry to be of a predetermined standard amount (e.g. 1.0 volts) for each of the different photocells 11 in the system when a predetermined reference light source is shone at the photocell(s) 11; a first voltage divider 143 including 12 kΩ resistor 216 and 3 kΩ resister 218 for providing a first predetermined voltage (e.g. 1.0 volts), that corresponds to the standard voltage, at point 145; second voltage divider 144 including 12 kΩ resistor 220 and 1.3 Ω resister 222 for providing a second predetermined lower voltage (e.g. 0.5 volts) at point 146; 0% calibration button 15 which is operatively associated with switch S1 to interrupt the sensed signal from cell 11, and instead provide 0 volts toward the amplification circuitry when button 15 is pressed; 50% calibration button 17 operatively associated with switch S2 so that when actuated or pressed, interrupting the sensed signal from cell 11 and providing the second predetermined lower voltage (e.g. 0.5 volts) toward the amplifying circuitry; 100% calibration button 19 operatively associated with switch S3 so that when pressed, interrupting the sensed signal from cell 11 and instead sending the first predetermined standard voltage (e.g. 1.0 volts) to the amplification circuitry, each of switches S1, S2, and S3 are normally closed or non-actuated (not pressed) as illustrated in FIG. 1 during normal light detection and signal amplification operations; delay or momentary hold circuitry including 510 kΩ resistor 39 and 1.0 $\mu$F capacitor 37 which function to keep the alarm circuitry 49 from indicating false alarms when different buttons are pushed as capacitor 37 momentarily holds a charge of the previously applied signal during push button switchover periods; op-amp buffer 41; fixed gain amplifier 43 in communication with 0.1 $\mu$F capacitor 224 which prevents oscillation in the amplifier 43, 1 kΩ resistor 226, 5.1 kΩ resistor 228; 1 kΩ resistor 230 [the output of fixed gain amplifier 43 is developed across resistor 230 and then fed to gain amplifier 44]; gain amplifier 44 including gain adjustment circuitry including 1 kΩ resistor 232, 1 kΩ resistor 234, and 10 kΩ adjustable rheostat 21; filtering 10 kΩ resistor 236; filtering 10 $\mu$F capacitor 238; op-amp buffer 47 [the output of buffer 47 goes directly to terminal 6 and to local alarm monitoring circuitry 49]; signal line 29 connecting the amplifying circuitry with alarm circuitry 49 and terminal 6; variable potentiometer 31 including 100 Ω resistor 240, 10 $\mu$F capacitor 242, and 5 kΩ adjustable resistor 244 for defining a predetermined threshold voltage below which a red light alarm 35 will be actuated at the output of comparator 150; resistor 246; connection point 248 that connects to the same 5.1 volt reference voltage that is then forwarded to potentiometer 31 for use in feeding a threshold voltage to comparator 150 at input 152, the comparator providing comparison to the amplified signal at 151; voltage comparator 150 including input 152 and input 151; 510 Ω resistors 250; 1 kΩ resistors 252; inverter 254 having an output in communication with an alarm diode ring, said inverter output going low when the comparator 150 output goes high thereby actuating green light emitting diode (LED) 33; red LED 35 which is actuated when the output of comparator 150 goes low (i.e. when input 151 to comparator 150 is lower than input 152); and finally inverter 256, diodes 258 and 260, and relay 262 which permit the FIG. 1 circuitry to be interfaced with valve shut offs or the like which may be actuated to shut off oil or air supplying a particular port when, for example, red LED 35 is actuated when the sensed and amplified signal provided at input 151 falls below the threshold voltage defined by potentiometer 31. Alternatively, transistors may be utilized instead of inverters 254 and/or 256 to actuate the LEDs in certain embodiments.

As illustrated in FIG. 1, the circuit includes three different calibration buttons 15, 17, and 19, respectively, which are provided so as to ensure that the circuit is calibrated and to check for errors. Buttons 15–19, which are normally not pushed and are separately actuatable, also help check communications throughout the system.

The FIG. 1 circuit includes its own gain control including amplifier 44 and rheostat 21 for calibrating and amplifying signals sent from either cell 11 or button(s) 15–19, and visually observable low level alarm circuitry 49 including potentiometer 31, comparator 150, inverter 254, and LEDs 33 and 35 which are provided to monitor and indicate low light level signals being received by photocell 11, with the alarm circuitry actuating a red light 35 when the voltage in line 29 falls below a predetermined threshold defined by potentiometer 31, and otherwise a green light 33 when the voltage at 29 and input 151 is above the threshold. A separate FIG. 1 circuit is provided for each of the injection ports in the blast furnace, with separate alarm LEDs 33 and 35 also, of course, being provided for each port.

In operation, an external power source, 18–24 volts AC or DC, feeds circuit terminals 1 and 2 through a rectifier and filter, to a 15 volt regulator 206 that supplies power to the rest of the circuit. A cable 508, coming from photocell 11 clip assembly 502 connects with terminals 3 and 4, and picks up the 5.1 volt circuit reference signal from terminal 3, loops it through photocell 11, and brings it back to circuit terminal 4, connecting it with 50 kΩ rheostat 25. The photocell 11 and rheostat 27 form a voltage divider to ground that is used to compensate for differences in the resistance characteristics of the different photocells 11 provided throughout the system (a different photocell 11 is provided for each injection port and furnace). The technician adjusts each rheostat 27 so that the voltage output from the corresponding photocell 11 is the same for all cells 11 in the system given a predetermined reference light intensity or source (this output voltage [e.g. 1.0 volt] given the reference light source is known as the circuit's "standard" voltage). The output of the voltage divider including cell 11 and rheostat 27 that is sent to the amplifying circuitry is known as the "sensed signal," which is a function of the amount of light from the furnace interior 523 hitting the photocell 11. Thus, rheostat 27 and cell 11 together establish and output to the amplifier circuitry, both the standard circuit voltage (e.g. 1.0 volt) and the sensed signal.

The signal from the voltage divider made up of photocell 11 and rheostat 25 travels along and through the line proximate buttons 15–19, through 1 kΩ resistor 27, and toward the amplifier circuit and gain control 21 during normal light detection and alarm monitoring operations when none of buttons 15–19 are pushed or actuated. When the signal from photocell 11 and rheostat 27 reaches amplification circuitry 13 of the circuit, gain control including amplifier 44 and rheostat 21 causes it to be increased by a predetermined factor (e.g. from a 1 volt standard voltage signal to a 10 volt amplified signal). Thereafter, the amplified signal proceeds through buffer 47 and line 29 to the amplifier output terminal 6 [to control room computers] and to the alarm circuitry 49 and interfacing circuitry feeding terminal 5.

This amplified signal is monitored by local alarm circuitry 49. In the alarm circuitry, potentiometer 31 including resistors 240, 244, defines a threshold voltage level (e.g. 3.5 volts) which is input to comparator 150 at input 152. The threshold voltage is typically from about 10% to 45% of the amplified standard voltage signal, and preferably about 35% of the amplified standard voltage signal (i.e. the threshold is 3.5 volts when the standard voltage is 1.0 volt and amplification is by a factor of ten). If the voltage coming through line 29 from the amplifier circuitry 13 that is input to comparator 150 at 151 is greater than the voltage threshold defined by potentiometer 31, then the green light remains on via LED 33. This is because when comparator input 151 is higher than comparator input 152, the comparator output goes high thereby causing inverter 254 to go low, which results in LED 33 (green light) being actuated or turned on due to the diode alignment.

However, when the voltage coming through line 29 and at 151 is below the threshold voltage defined by potentiometer 31 (e.g. when the voltage in line 29 is 2.0 volts and the threshold defined by potentiometer 31 is 3.5 volts), then the alarm goes off by a red light being emitted from LED 35, as green light 33 is turned off. This is because when the voltage at comparator input 151 is lower or less than the threshold voltage provided at comparator input 152, then comparator 150 goes low thereby turning on LED 35, but not LED 33, due to the orientation of LEDs 33 and 35. Accordingly, when LED 33 is actuated and LED 35 is not, and green light is emitted therefrom, this is an indication that photocell 11 is receiving a satisfactory amount of light from the peephole 503 and that the injection port at issue is not clogged or blocked. However, when green light diode 33 is deactuated, and red light diode 35 is actuated, this is an indication that the light being received by photocell 11 from the injection port peephole is below a predetermined threshold defined by potentiometer 31, and therefore the injection port may be clogged or blocked. At this time, the system may automatically shut off the material (oil and/or gas) being fed into the injection port via the interfacing circuitry 256–262 so as to prevent further problems.

Calibration buttons 15, 17, and 19, respectively, each define a different percentage of the maximum potential voltage output from photocell 11 (i.e. a percentage of the circuits "standard" voltage). Each of these buttons has their own separate power terminal created by voltage dividers 143–144 which affect the reference voltage at point 3. In certain embodiments, button 15 defines a 0% button which sends 0 volts to the amplifier circuitry when button 15 is pushed, calibration button 17 defines a 50% button and sends a signal to the amplification circuitry that is 50% of the circuit's standard voltage, and calibration button 19 is a 100% button which sends a voltage to the amplification circuitry that is 100% of the circuit's standard voltage. In certain embodiments, when the photocell 11 is standardized so that its maximum potential signal, given rheostat 27 adjustment discussed below and the reference light source intensity, is 1 volt (this is the circuits standard voltage), then button 15, when actuated or pressed, will cause a 0 volt signal to be fed toward resistor 27 toward the amplification circuitry and alarm circuitry; button 17, when actuated, will cause a 0.5 volt signal to be fed toward resistor 27 and toward the amplification circuitry; and button 19 when actuated, will cause a 1.0 volt signal (standard voltage signal) to be fed toward resistor 27 and the amplification and alarm circuitry. The percentages discussed above for calibration buttons 15–19 are exemplary, and may be changed as will be recognized by those of skill in the art.

During normal operations of the FIG. 1 circuitry, each of buttons 15, 17, and 19 are not actuated (i.e. their corresponding switches S1, S2, and S3 are as illustrated in FIG. 1), so that the sensed signal from the photocell 11 is fed through resistor 27 and the amplification circuitry toward the terminal 6 and alarm circuitry 49. When an operator pushes one of buttons 15–19, the signal from the photocell 11 at issue is interrupted or cut off, and a voltage from the calibration button that has been pushed, is placed to the input of amplifier 44. As discussed above, these voltages in certain embodiments may be 0 volts for 0% button 15, 0.5 volts for 50% button 17, and 1 volt for 100% button 19, when the maximum available or 100% voltage from photocell 11 is a standard voltage of 1.0 volt. Thus, for example, an operator may check operation of the FIG. 1 circuit by pressing button 15 when the potentiometer 31 has set input 152 to comparator 150 to 3.5 volts (or 35% of a 1.0 volt standard voltage given a ten-fold amplification)—red LED 35 should be actuated. If the operator instead pushes either button 17 or 19, green LED 33 should be actuated.

Capacitor 37 and termination resistor 39 are provided to form a short delay to overlap signal interruption when one of push buttons 15–19 is actuated, for the purpose of eliminating undesirable alarms.

The signal from photocell 11, or the signal from one of buttons 15–19 when actuated, enters two buffered stages 41 and 43 of the amplifier circuitry, and then feeds the gain control circuitry including amplifier 44 and rheostat 21, the gain control circuitry setting the gain of amplifier 44 to a predetermined level (e.g. so as to amplify the signal ten-fold from 1 volt to 10 volts). In certain embodiments, when a 1 volt standard voltage signal is provided to the amplification circuitry when button 19 is actuated, the amplification circuitry outputs a 10 volt signal in response thereto, toward the alarm circuitry. The signal from gain control circuitry 21 flows through RC network 45 and through buffer section 47 and thereafter to output terminals 6 and 7, and finally to the bar graph displays in the control room.

A localized on-board [not in control room] low level alarm defined by alarm circuitry 49, including potentiometer 31, is adjustable to a threshold ranging from between 0 and 50% (e.g. preferably from about 10–45%, and most preferably about 35%) of the amplified standard voltage signal.

FIG. 2 is a circuit diagram of a flame intensity meter which may be used during calibration of or validation of the circuitry of FIG. 1, according to certain embodiments of this invention. This flame intensity meter is a stand alone measuring device able to detect and measure light intensity directly from the peepsight 503 viewing window via a cadmium sulfide photocell 11 that is a separate cell from the cell in FIG. 1. Once it is calibrated, the meter serves as a calibrator to the 100% reference light source to be discussed below in FIG. 3. The circuitry of the meter is similar to that of FIG. 1, with a few exceptions. The meter utilizes an analog meter 61 with dual meter scales switchable via switch 154 between X1 (100%) and X2 (200%) scales. The meter includes its own photocell 11 element and peepsight clip assembly 502 and a regulated power supply. Furthermore, it includes its own rechargeable battery 71 and a constant current charger 73 with a battery test button 63 to keep track of the battery condition, and includes a read button 65 to activate the meter during measurements, and 0% and 100% push buttons 67 and 69, respectively, to track the tester calibration. The tester is assembled in a 4" diameter by 3.5" long PVC pipe (not shown) with analog meter 61 and read button 65 in the front. Mounted in the rear of the elongated pipe are a photocell 11 clip assembly 502, a power jack, test button 63, and a meter scale switch for actuating switch 154.

The flame intensity meter of FIG. 2 is powered by a rechargeable 7.2 volt nickel cadmium battery 71 and an on board constant current charger 73, including a built-in eight point volt regulator 75. Optionally, instead of powering the FIG. 2 meter by way of battery 71, an external power supply or transformer may be utilized to power the meter and may be attached to the illustrated circuitry at inputs 301. Thus, the meter may be powered either by battery 71 or alternatively by the external AC or DC source. In general, the flame or light intensity meter of FIG. 2 includes the following elements: battery 71; current charger 73; regulator 75; diode 303; diode 305; 100 $\mu$F capacitor 307 [these diodes 303 and 305 and capacitor 307 ensure that only DC voltage will feed charger 73 and regulator]; 1.5 kΩ resistor 309; 270 Ω resistor 311 [resistors 309 and 311 establish the 8 volt output from regulator 75]; 10 $\mu$F capacitor 313 for filtering; 0.1 $\mu$F capacitor 315 for filtering; diode 317 and diodes 319 ensuring that the supply voltage to the amplifier is approximately 6.5 volts regardless of the source; zener diode 321 that provides a circuit reference voltage (e.g. 5.1 volts) at point 323; photosensitive resistor photocell 11 including variable resistance 79; adjustable rheostat 83 which when adjusted results in a predetermined standard voltage being output from the photocell/rheostat toward the amplifiers given a predetermined 100% light intensity impinging upon photocell 11; read button 65 which connects contacts E and F so as to allow meter 61 to generate a reading; voltage divider 325 including 12 kΩ resistor 327 and 3 kΩ resistor 329 for providing the standard voltage (e.g. 1 volt) to terminal 331 (i.e. the voltage applied at terminal 331 should be substantially equal to that provided to buffer 91 when photocell 11 forwards a sensed signal given a 100% light intensity impinging thereon when buttons 67 and 69 are not pressed as illustrated); 0% calibration button 67 which actuates double pole switch 333; 100% calibration button 69 which actuates double pole switch 335; delay circuitry 337 including a 510 kΩ resistor and a 1 $\mu$F capacitor form a short time signal holding circuit prevent readings on meter 61 from fluctuating during button operation; buffers 91 and 93; gain amplifier 95 including gain rheostat circuitry 97; switch 154; battery test button 63; and meter 61.

When read button 65 is pushed, power is applied to the amplifier circuitry 77, namely to input 4 of op-amp buffer 93. Light through the peephole 503 enters photocell 11, alters the cell's resistance 79 in proportion to the light observed by the photoresistive element. Current flows from a 5.1 volt reference zener diode source 321, through photocell 11 and rheostat 83 to ground 85 to form a variable voltage divider. From there, the sensed signal is connected through normally non-pressed test buttons 67 and 69 into two stages of buffering, namely at 91 and 93. Then the sensed signal flows into gain stage 95 where the final amplifier gain is selected by rheostat 97. From the gain stage, the signal is slowed down by RC network 99 and applied to meter driver 101. The signal is then divided into two paths 103 and 104 and selected by meter scale switch 154, to display either 100% or 200% scale readings.

As discussed above, during normal operations, an operator can cause meter 61 to generate a reading of the light being received by photocell 11 by pushing read button 65 which connects terminals E and F. When terminals E and F are connected, power is supplied to the amplifier circuitry at amplifier 93 from either battery 71 or the external power supply via regulator 75. When the amplifier circuitry is powered, the sensed signal from photocell 11 fed thereto is amplified and may thereafter be measured at analog meter output 61. When no power is supplied to amplifier 93 (i.e. when terminals E and F are not bridged), the meter 61 will remain at 0. It is noted that because each of switches 333 and 335 are of the double pole type, when one of buttons 67 and 69 is pressed, (i) the sensed signal from cell 11 is cut off or isolated, and (ii) there is no need to also push read button 65 for meter 61 to read the signal from the button. This is because, when looking at buttons 69, for example, the actuation of both poles of switch 335 results in: (i) the 1.0 volt standard signal from terminal 331 being fed to buffer 91; and (ii) the read button switch 65 being bypassed as power is applied directly to amplifier 93. This is also the case with switch 333 when button 67 is pressed.

FIG. 3 is a circuit diagram of the reference light source which may be used in calibrating the circuits of FIGS. 1 and 2 in certain embodiments of this invention. The reference light source of FIG. 3 is an adjustable light intensity source, with current and voltage regulation, that is calibrated to output the amount of light chosen for 100% intensity. The light source head has the same mounting characteristics as the peepsight nut 510 so that when it is inserted into the photocell 11 clip 502 it will transmit its standardized predetermined reference light energy into the photocell element 11 so that the photocell 11 receives same. The purpose of the light reference source of FIG. 3 is to help standardize all of the photocells 11 (of FIGS. 1 and 2) and their photoresistive elements and outputs in the array attached to the furnace. The reference light source is powered by five "D" cell batteries 111–115 with built-in voltage monitor 411, to generate an alarm when the battery voltage drops below the limits of the regulator. If this happens, an indicator light output will flash from a steady to a blinking condition, indicating a low battery. The FIG. 3 circuitry is mounted on two separate printed circuit boards, piggybacked together, one of the boards (FIG. 3(*a*)) being a battery voltage monitor and the other (FIG. 3(*b*)) for voltage and current regulation to the bulb 116. Batteries, printed circuit boards, reflector 117, and diffusing glass 118, are all assembled inside elongated PVC pipe parts (not shown), to form the elongated reference light source assembly inside of the PVC tube.

Still referring to FIG. 3, the circuitry for the reference light source is designed around three major parts, battery monitoring circuitry, blinking circuitry, and voltage/current regulation circuitry. As stated above, power to the light source is supplied by batteries 111–115 that apply power via the voltage monitoring board to an adjustable regulator 121 located on the regulated board. Regulator 121 is responsible for 100% intensity to the light source 116. Intensity adjusting rheostat 123 satisfies the voltage required for the 100% light intensity to bulb 116. A visually observable LED indicator 125 is also provided on the regulator board. A feedback resistor applies the output of the regulator to a forward biased diode to generate a reference voltage of 0.63 volts DC to input 402 of comparator 127 on the voltage monitor board. A voltage divider monitors the battery level across the batteries and feeds it to input 403 of 127. If the voltage across the batteries becomes less than 4.75 volts DC, the level at 403 becomes less than the reference level at 402 causing its output 131 to go high thereby removing reset from 132. Thereafter, an astable operation begins and the oscillator begins to generate pulses at its output 133 at a rate determined by the RC time constant of the oscillator. These pulses are transferred to the control terminal of the regulator turning it on and off, causing its indicator 125 and bulb 116 to flash.

Exemplary calibration procedures for the invention discussed above in FIGS. 1–5 will now be described. Firstly, the operator utilizes the FIG. 2 flame intensity meter to measure the intensity coming out of all peepsights 503 (each peepsight corresponds to an injection port). Thereafter, the operator selects a light level at approximately 75% between the weakest read peepsight signal and the strongest read signal and calls it "100% reference intensity." This is the 100% reference light level or intensity. The operator then turns on the FIG. 3 reference light source and shines it into the flame detection meter of FIG. 2, and adjusts the intensity rheostat 123 of the reference light source so as to cause it to output the "100% intensity" reference light level referenced above. Thus, the reference light source of FIG. 3 is calibrated so that bulb 116 emits a signal that is considered the 100% reference intensity light signal. If all amplifiers upon calibration are considered satisfactory, then the FIG. 3 light source becomes a 100% light reference. Next, the FIG. 1 circuitry must be calibrated. Firstly, the FIG. 1 circuit is designed so as to define a particular reference voltage (e.g. 5.1 volts) and voltage dividers 143 and 144 are provided so that from the reference voltage, a first predetermined standard voltage (e.g. 1.0 volts) is provided at point 145 and a second predetermined lower voltage (e.g. 0.5 volts) is provided at point 146. The meter is then connected between ground (e.g. point 142) and point 141 and 100% calibration button 19 is pressed. The meter should read 1 volt DC when the above exemplary voltages are provided. The meter is then moved between ground and point 148, and 100% calibration button 19 again pressed. When button 19 is pressed, the operator adjusts gain rheostat 21 so that the meter outputs a 10 volt DC reading, thereby causing the amplifying circuitry to amplify ten-fold (or by any other predetermined amount) the 1 volt standard signal to a 10 volt amplified standard value. This calibration is uniform throughout all amplifiers and cells 11 in the multiple port system, and remains the same. When the meter is still connected between ground and point 148, the FIG. 3 reference light source, previously calibrated to output the reference light intensity, is shone into photocell 11 and the operator adjusts rheostat 27 for a 10 volt reading on the meter. Thus, rheostat 27 is adjusted so that given the particular photocell 11 in the circuit, when the 100% reference light source is shone thereon, the result is a 1.0 volt sensed standard voltage signal being applied to the amplification circuit when each of buttons 15–19 is not being pushed, as is the case during normal operations. In practice, two separate technicians or people equipped with radios may be needed for calibration [one shining the reference light source into cell, and the other calibrating rheostat 27]. Thereafter, the operator connects the meter across ground and point 149 and adjusts the alarm threshold potentiometer 31 so as to define a particular voltage threshold (e.g. 3.5 volts DC). For example, when potentiometer 31 is adjusted so that the meter reads 3.5 volts and the standard voltage is 1.0 volts (and the amplified standard voltage is 10.0 volts), this means that the alarm threshold is set so that when photocell 11 detects light intensity less than 35% of the reference light source, the red light 35 alarm signal is actuated. In other words, when the voltage output from the amplification circuitry along line 29, and entering comparator 150 at 151 is greater than 3.5 volts then green LED 33 is actuated, and when the voltage at input 151 of comparator 150 is less than 3.5 volts, then red LED 35 is actuated.

To calibrate the FIG. 2 flame intensity meter, another meter is first connected across ground and point 153, with 100% calibration button 69 being pressed with meter switch 154 being in the illustrated "X1" position. Then, gain rheostat 83 is adjusted to a 100% full scale reading on the meter. Thereafter, switch 154 is moved to "X2," at which point the meter reading should become half as much as the previous reading (this is a 200% meter scale). The operator then reverts switch 154 back to the X1 100% meter position and shines the reference light source into photocell 11 of the FIG. 2 circuit and presses read button 65. Then, the operator adjusts potentiometer 83 for a 100% signal.

Once given the above disclosure, many other features, modifications, and improvements will become apparent to the skilled artisan. Such other features, modifications, and improvements are therefore considered to be a part of this invention, the scope of which is to be determined by the following claims.

I claim:

1. A method of detecting potential blocking or clogging of a tuyere in a blast furnace, the method comprising the steps of:

positioning a photosensitive sensor adjacent the tuyere, the sensor including an electrical parameter that varies as a function of intensity of light detected by the sensor;

calibrating a circuit so that a standard voltage is forwarded from the sensor toward amplifying means when the photosensitive sensor detects a reference amount of light;

the sensor detecting light emitted from within the furnace through the tuyere and forwarding an actual sensed signal toward the amplifying means in response thereto;

the amplifying means amplifying the actual sensed signal forwarded from the sensor so as to form an amplified signal having a voltage that is indicative of light intensity within the furnace adjacent the tuyere;

providing a threshold voltage which is a percentage of the standard voltage amplified by the amplifying means; and comparing the voltage of the amplified signal to the threshold voltage and actuating an alarm when the voltage of the amplified signal is less than the threshold voltage thereby indicating potential clogging or blocking of the tuyere.

2. The method of claim 1, further comprising the steps of:

providing a circuit reference voltage which is supplied to the sensor, and utilizing the reference voltage to establish the threshold voltage, the reference voltage being greater than the standard voltage but less than the standard voltage amplified by the amplifying means.

3. The method of claim 1 further comprising the steps of:

adjusting a resistance in conjunction with the sensor in said calibrating step so as to establish the standard voltage.

4. The method of claim 3, wherein the resistance includes a rheostat, so that the photocell and rheostat establish the standard voltage.

5. The method of claim 1, further comprising the steps of:

providing first and second calibration buttons; and actuating the first calibration button so as to cut off the actual sensed signal from the amplifying means thereby isolating the sensor from the amplifying means, said actuating of the first calibration button causing a first voltage less than the standard voltage to be forwarded to the amplifying means for amplifying.

6. The method of claim 5, further comprising the steps of:

actuating the second calibration button so as to cut off the actual sensed signal from the amplifying means, said actuating of the second calibration button causing a second voltage substantially equal to the standard voltage to be forwarded to the amplifying means for amplifying.

7. The method of claim 1, further comprising the steps of:

utilizing a potentiometer to define the threshold voltage;

providing a comparator having a first input, a second input, and an output connected to alarm means;

providing the threshold voltage to the first input of the comparator, the amplified signal to the second input of the comparator, and causing the comparator to output a signal actuating the alarm means when the voltage at the second input is less than the voltage at the first input.

8. The method of claim 1, wherein said amplifying step amplifies the actual sensed signal by a gain; and wherein the threshold voltage is from about 10%–45% of the standard voltage amplified by the predetermined gain.

9. The method of claim 8, wherein the threshold voltage is about 35% of the standard voltage amplified by the gain.

10. The method of claim 1, wherein said actuating an alarm step includes turning on a light emitting diode when the voltage of the amplified signal is less than the threshold voltage.

11. A combination peepsight and light detector for use in a blast furnace tuyere sensor system, the combination comprising:

a tuyere communicating with an interior of the furnace;

a blowpipe through which oil and heated gas are introduced into the blast furnace;

an oil channel defined in the blowpipe through which oil is introduced into the furnace;

a peepsight structure connected to said blowpipe so that said peepsight structure and said blowpipe are positioned along a common axis;

a photoresistive photocell connected to said peepsight structure, said photocell including a resistance that varies as a function of light intensity received from the interior of the furnace through an optical filter;

said optical filter positioned inboard of said photocell and outboard of said peepsight structure so as to be located between said photocell and said peepsight structure, thereby enabling said photocell to view the interior of the furnace through each of said peepsight structure and said optical filter; and wherein portions of said optical filter and said photocell are each located along said common axis.

12. The combination of claim 11, further comprising a multi-pronged spring loaded clip housing said photocell therein for connecting said photocell to said peepsight structure.

13. The combination of claim 12, wherein said peepsight structure includes a nut, and wherein said multi-pronged spring loaded clip is connected around the outer periphery of said nut, and wherein said photocell is in optical communication with the interior of the furnace through an aperture defined within said nut.

14. A system for detecting potential blockage or clogging of a tuyere in a blast furnace, the system comprising:

a photosensitive sensor including light detection means positioned adjacent the tuyere, said sensor including an electrical parameter that varies as a function of intensity of light received;

means for calibrating the system so that a standard voltage is forwarded from said sensor toward amplifying means when said sensor detects a reference amount of light;

said sensor detecting light from within the furnace through the tuyere, resulting in forwarding of an actual sensed signal toward said amplifying means in response thereto;

said amplifying means for amplifying the actual sensed signal so as to form an amplified signal having a voltage that is indicative of light intensity within the furnace adjacent the tuyere; and means for comparing the voltage of the amplified signal to a threshold voltage, and actuating an alarm when the voltage of the amplified signal is less than said threshold voltage thereby indicating potential clogging or blockage of the tuyere.

15. In a blast furnace having a tuyere communicating with an interior space of the blast furnace, a blowpipe through which oil and a hot blast are introduced into the interior space, and a peepsight structure attached to one end of the blowpipe opposite the tuyere, an improved combination peepsight and light detector comprising:

a photoresistive photocell detachably connected to said peepsight structure along a common axis, said photocell including a resistance that varies as a function of light intensity received from the interior of the furnace;

an optical filter position inboard of said photocell and outboard of said peepsight structure so as to be located between said photocell and said peepsight structure, thereby enabling said photocell to view the interior of the furnace through said peepsight structure and said optical filter, and wherein said common axis intersects each of said optical filter and said photocell.

16. A combination peepsight and light detector for use in a blast furnace tuyere sensor system, the combination comprising:

a tuyere communicating with an interior of the blast furnace;

a blowpipe through which oil and heated gas are introduced into the blast furnace;

a peepsight structure connected to said blowpipe so that said peepsight structure, said tuyere, and said blowpipe are all aligned along a common axis;

photosensitive means detachably connected to said peepsight structure, said photosensitive means for receiving light from the interior of the furnace through the tuyere and peepsight structure and for forwarding a signal in response thereto to signal analyzing means located remotely from the tuyere, said common axis intersecting said photosensitive means; and a multi-pronged spring loaded clip housing said photosensitive means therein, said spring-loaded clip detachably connecting said photosensitive means to said peepsight structure.

17. The combination of claim 16, wherein said peepsight structure includes a nut, and wherein said multi-pronged spring loaded clip connects to the outer periphery of said nut, and wherein said photosensitive means is in optical communication with the interior of the furnace through an aperture defined within said nut.

* * * * *